US006878933B1

(12) United States Patent
Coon

(10) Patent No.: US 6,878,933 B1
(45) Date of Patent: Apr. 12, 2005

(54) METHOD FOR COUPLING LASER DESORPTION TO ION TRAP MASS SPECTROMETERS

(75) Inventor: Joshua J. Coon, Charlottesville, VA (US)

(73) Assignee: University of Florida, Gainesville, FL (US)

( * ) Notice: Subject to any disclaimer, the term of this patent is extended or adjusted under 35 U.S.C. 154(b) by 0 days.

(21) Appl. No.: 10/732,972

(22) Filed: Dec. 10, 2003

Related U.S. Application Data

(60) Provisional application No. 60/433,281, filed on Dec. 10, 2002.

(51) Int. Cl.[7] ..... H01J 49/26; H01J 49/40; H01J 49/00

(52) U.S. Cl. ..... 250/290; 250/293; 250/288; 250/282; 250/291; 250/292; 250/297

(58) Field of Search ..... 250/290, 293, 250/282, 288, 291, 292, 297, 284, 287

(56) References Cited

U.S. PATENT DOCUMENTS

| | | | | |
|---|---|---|---|---|
| 5,663,562 | A | 9/1997 | Jones et al. | |
| 5,965,884 | A | 10/1999 | Laiko et al. | |
| 6,534,764 | B1 * | 3/2003 | Verentchikov et al. | 250/287 |
| 6,545,268 | B1 * | 4/2003 | Verentchikov et al. | 250/287 |
| 6,670,606 | B2 * | 12/2003 | Verentchikov et al. | 250/287 |
| 6,683,301 | B2 * | 1/2004 | Whitehouse et al. | 250/288 |
| 6,762,561 | B1 * | 7/2004 | Kawato | 315/39.51 |
| 2003/0141447 | A1 * | 7/2003 | Verentchikov et al. | 250/287 |
| 2004/0183007 | A1 * | 9/2004 | Belov et al. | 250/287 |

OTHER PUBLICATIONS

Coon, J.J. et al. "Atmospheric Pressure Laser Desorption/Chemical Ionization Mass Spectrometry: A New Ionization Method Based on Existing Themes" *Rapid Communications in Mass Spectrometry,* 2002, pp. 681–685, vol. 16.

Coon, J.J. and Harrison, W.W. "Laser Desorption–Atmospheric Pressure Chemical Ionization Mass Spectrometry for the Analysis of Peptides from Aqueous Solutions" *Anal. Chem.,* Nov. 1, 2002. pp. 5600–5605, vol. 74 (indicates published on the Web Sep. 14, 2002).

Creaser, C.S. et al. "Structural Analysis of Oligosaccharides by Atmospheric Pressure Matrix–Assisted Laser Desorption/Ionisation Quadrupole Ion Trap Mass Spectrometry" *Rapid Communications in Mass Spectrometry,* 2002, pp. 176–184, vol. 16.

Galicia, M.C. "Atmospheric Pressure Matrix–Assisted Laser Desorption/Ionization in Transmission Geometry" *Anal. Chem.,* Apr. 15, 2002, pp. 1891–1895, vol. 74 (indicates published on the Web Mar. 16, 2002).

Keough, T. et al. "Atmospheric Pressure Matrix–Assisted Laser Desorption/Ionization Ion Trap Mass Spectrometry of Sulfonic Acid Derivatized Tryptic Peptides" *Rapid Communications in Mass Spectrometry* 2001, pp. 2227–2239, vol. 15.

Laiko, V.V. et al. "Atmospheric Pressure Laser Desorption/Ionization on Porous Silicon" *Rapid Communications in Mass Spectrometry,* 2002, pp. 1737–1742, vol. 16.

(Continued)

*Primary Examiner*—John R. Lee
*Assistant Examiner*—Bernard E. Souw
(74) *Attorney, Agent, or Firm*—Saliwanchik, Lloyd & Saliwanchik

(57) ABSTRACT

The subject invention provides improved methods for injecting ions into a quadrupole ion trap mass spectrometer (QIT-MS). The methods of the subject invention are applicable to procedures involving atmospheric pressure laser desorption (AP-LD) of a sample to be investigated. Specifically, the subject invention involves controlling the pulse frequency of the laser such that the laser pulses are synchronized with changes in radiofrequency (RF) amplitude levels of the QIT-MS. Advantageously, by utilizing the methods of the subject invention it is possible to improve the accuracy and reproducibility of the results while improving duty cycle and reducing sample consumption.

54 Claims, 3 Drawing Sheets

OTHER PUBLICATIONS

Laiko, V.V. et al. "Atmospheric Pressure MALDI/Ion Trap Mass Spectrometry" *Anal. Chem.,* Nov. 1, 2000, pp. 5239–5243, vol. 72 (indicates published on the Web Sep. 23, 2000).

Laiko, V.V. et al. "Desorption/Ionization of Biomolecules from Aqueous Solutions at Atmospheric Pressure Using an Infrared Laser at 3 μm" *Am. Soc. Mass. Spectrom,* 2002, pp. 354–361, vol. 13 (indicates published on–line Feb. 14, 2002).

Moyer, S.C. and Cotter, R.J. "Atmospheric Pressure MALDI" *Anal. Chem.,* Sep. 1, 2002, pp. 469–476.

Moyer, S.C. et al. "Fragmentation of Phosphopeptides by Atmospheric Pressure MALDI and ESI/Ion Trap Mass Spectrometry" *J. Am. Soc. Mass. Spectrom.,* 2002, pp. 274–283, vol. 13 (indicates published on–line Jan. 22, 2002).

* cited by examiner

METHOD FOR COUPLING LASER DESORPTION TO ION TRAP MASS SPECTROMETERS

CROSS-REFERENCE TO RELATED APPLICATION(S)

This application claims the benefit of U.S. Provisional Application No. 60/433,281, filed Dec. 10, 2002, which is hereby incorporated by reference in its entirety, including all figures, tables, and drawings.

The subject invention was made with government support under a research project supported by National Institute of Health, Grant No. 2P42 ES07375.

BACKGROUND OF THE INVENTION

Mass spectrometers are widely used in analytical chemistry. Analysis of a sample used in a mass spectrometer requires the production of analyte ions. Ion sources are well known in the art and may be divided into two groups: vacuum ionization ion sources and atmospheric pressure ionization sources. The second group, atmospheric pressure ionization sources, includes atmospheric pressure chemical ionization and Electrospray Ionization (ESI). To sample atmospheric pressure ions a mass spectrometer must be equipped with Atmospheric Pressure Interface (API) to transfer ions from an external region of atmospheric pressure to a mass analyzer under high vacuum.

Two significant recent advancements have expedited the development of mass spectrometry as a tool in analytical chemistry. These are Matrix Assisted Laser Desorption Ionization (MALDI) and Electrospray Ionization (ESI) techniques. Both MALDI and ESI enable the production of intact heavy molecular ions from a condensed phase (solid phase for MALDI and liquid phase for ESI). The advantages of MALDI include simplicity of sample preparation, stability, and high tolerance to sample contamination. An API is used to transfer ions from an atmospheric pressure ion source, to the vacuum of a mass spectrometer. This interface has a low efficiency and, consequently, atmospheric pressure MALDI has not been widely applied because of the concern that not enough ions are generated to compensate for the loss of ions due to the API.

Franzen et al. developed a method, disclosed in U.S. Pat. No. 5,663,562, for ionizing heavy analyte molecules deposited on a solid support in a gas at atmospheric pressure. The analyte molecules' are deposited together with decomposable (explosive) matrix material and then blasted into the surrounding gas under atmospheric pressure as a result of decomposition of matrix material under laser irradiation. Neutral gas-phase analyte molecules are produced at this stage which are then ionized by atmospheric pressure chemical ionization for further analysis by a mass spectrometer.

An Atmospheric Pressure Matrix Assisted Laser Desorption (AP-MALDI) apparatus is described in U.S. Pat. No. 5,965,884. The '884 patent describes a system wherein MALDI-type spectra can be recorded using any type of mass spectrometer equipped with API without essential modifications. The AP-MALDI apparatus described in the '884 patent has three parts: an atmospheric pressure ionization chamber which hosts a sample to be analyzed; a laser system outside the ionization chamber for illuminating the sample in the ionization chamber; and an interface which connects the ionization chamber to the spectrometer. The ionization chamber is filled with a non-reactive bath gas at or near atmospheric pressure. The ionization chamber has a window through which the illuminating laser beam enters. The sample typically is a mixture of analyte materials and light-absorbing matrix substances. The sample is deposited on the surface of a support. When illuminated with the laser beam, the matrix molecules are ionized and evaporated. The ionized matrix molecules ionize the analyte molecules through a charge transfer process. The interface between the ionization chamber and the spectrometer has an inlet orifice to allow the ionized analyte to enter the spectrometer. The laser system comprises a pulsed laser and optics. The laser beam is focused by a focusing lens positioned outside the ionization chamber.

AP-MALDI takes place under atmospheric pressure conditions. The AP-MALDI technique provides a stable ion supply to the mass spectrometer.

Since the initial reports of atmospheric pressure-matrix-assisted laser desorption/ionization (AP-MALDI; Laiko U V, Moyer S C, Cotter R J., 2000, *Analytical Chemistry* 72:5239–5243; Keough T, Lacey M P, Strife R J. *Rapid Communications in Mass Spectrometrey*), several laboratories have been pursuing the development of AP-MALDI, (Moyer S C, Cotter R J, Woods A S, 2002, *Journal of the American Society for Mass Spectrometry* 13:274–283; Galicia M C, Vertes A, Callahan J H, 2002, *Analytical Chemistry* 74:1891–1895; Creaser C S, Reynolds J C, Harvey D J, 2002, *Rapid Communications in Mass Spectrometry* 16:176–184; Moyer S C, Cotter R J., 2002, *Analytical Chemistry* 74:469A–476A; Laiko V V, Taranenko N I, Berkout V D, Yakshin M A, Prasad C R, Lee S H, Doroshenko, V M, 2002, *Journal of the American Society for Mass Spectrometry* 13:354–361; Laiko V V, Taranenko N I, Berkout V D, Musselman, Doroshenko V M, 2002, *Rapid Communications in Mass Spectrometry* 16:1737–1742) atmospheric pressure laser desorption/ionization from porous silicon (AP-DIOS), and laser desorption-atmospheric pressure chemical ionization (LD-APCI) (Coon, J J, McHale, K J, Harrison, W W, 2002, *Rapid Communications in Mass Spectrometry* 16:681–685; Coon J J, Harison W W, 2002, *Analitical Chemistry* 74).

Though each of these AP-Laser Desorption techniques may possess certain advantages with respect to the others, they also share some important similarities. First, quadrupole ion trap mass spectrometers (QIT-MS) have been used almost exclusively for AP-laser desorption studies; second, each of the methods employs an absorbing analyte-containing matrix to effect either the desorption/ionization of gas-phase analyte ions (AP-MALDI, AP-DIOS) or the desorption of gas-phase analyte molecules (LD-APCI). Therefore, studies aimed to understand the basic processes in AP-laser desorption (AP-LD) could play a significant role in their continued development.

Interest in AP-MALDI has stimulated QIT-MS manufacturers to develop and make available commercial interfaces. Despite this interest, surprisingly little effort has been reported on the fundamental processes common to all AP-LD procedures. Though AP-LD methods are seemingly straightforward, knowledge of such processes will almost certainly be a prerequisite for their optimal employment in mass spectrometry.

Unlike vacuum MALDI-TOF-MS instruments, AP-LD-QIT-MS allows the accumulation of ions generated from multiple laser pulses into a single mass analysis event. Indeed, the majority of the reported AP-LD experiments have taken advantage of this opportunity by asynchronously coupling laser pulses (~10 Hz) with fixed ion trapping periods of (~200–500 ms) (Keough T, Lacey M P, Strife R J. *Rapid Communications in Mass Spectrometrey; Moyer S*

C, Cotter R J, Woods A S, 2002, *Journal of the American Society for Mass Spectrometry* 13:274–283; Galicia M C, Vertes A, Callahan J H, 2002, *Analytical Chemistry* 74:1891–1895; Creaser C S, Reynolds J C, Harvey D J, 2002, *Rapid Communications in Mass Spectrometry* 16:176–184; Moyer S C, Cotter R J, 2002, *Analytical Chemistry* 74:469A–476A; Laiko V V, Taranenko N I, Berkout V D, Yakshin M A, Prasad C R, Lee S H, Doroshenko, V M, 2002, *Journal of the American Society for Mass Spectrometry* 13:354–361; Laiko V V, Taranenko N I, Berkout V D, Musselman, Doroshenko V M, 2002, *Rapid Communications in Mass Spectrometry* 16:1737–1742) In an AP-MALDI experiment, Laiko et al. report that this approach generates a quasi-continuous ion beam; (Creaser C S, Reynolds J C, Harvey D J, 2002, *Rapid Communications in Mass Spectrometry* 16:176–184; Moyer S C, Cotter R J, 2002, *Analytical Chemistry* 74:469A–476A), however, it seems unlikely that MALDI-generated ions would be continuously produced during the entire 100 ms intermission of the nanosecond laser pulses. Moreover, the temporal width of each ion pulse relative to the injection period may have important implications regarding efficient ion injection across the entire mass range. This is because most QIT-MS systems are designed to use several levels of radiofrequency (RF) amplitude during a fixed ion injection period to optimally inject ions across the entire mass range. Consequently, a fundamental understanding of the ion pulse temporal profile following AP-LD will be essential for its for optimal coupling to QIT-MS.

BRIEF SUMMARY OF THE INVENTION

The subject invention provides improved methods for injecting ions into a quadrupole ion trap mass spectrometer (QIT-MS). The methods of the subject invention are applicable to procedures involving atmospheric pressure laser desorption (AP-LD) of a sample to be investigated. Specifically, the subject invention involves controlling the pulse frequency of the laser such that the laser pulses are synchronized with changes in radiofrequency (RF) amplitude levels of the QIT-MS. Advantageously, by utilizing the methods of the subject invention it is possible to improve the ion injection efficiency, and thus reproducibility of the results while improving duty cycle and reducing sample consumption.

The subject invention arises from the discovery that the ion pulse produced during laser desorption-atmospheric pressure chemical ionization (LD-APCI) and atmospheric pressure-matrix-assisted laser desorption/ionization (AP-MALDI) to be relatively short. With short ion pulses, asynchronous modes of coupling AP-laser desorption (AP-LD) to quadrupole ion trap mass spectrometers (QIT-MS) will typically result in poor duty cycles (on the order of ~4%). Furthermore, random laser pulses within a fixed ion injection period produce highly erratic mass spectra when scanning across a wide mass range due to the injection of ions into varying levels of RF amplitude.

Accordingly, the instruments and methods of the subject invention utilize rapid laser pulses that are synchronized to changes in the injection RF levels. The instruments and methods of the subject invention advantageously reduce sample consumption, improve duty cycle, and provide enhanced scan-to-scan reproducibility.

In a preferred embodiment of the subject invention, the AP-LD-QIT-MS interface have lasers that operate with high repetition rates (~100 Hz), and the ion pulses they generate are triggered to correspond with changes in injection RF levels so that the entire mass range can be consistently injected into the ion trap scan after scan.

Advantageously, the methods of the subject invention can be-readily introduced into pre-existing (commercially-available) laser desorption ion trap mass spectrometer systems by straightforward software code modifications made in accordance with the teachings of the subject invention. Accordingly, one aspect of the subject invention is the software used to implement the methods described herein.

DETAILED DISCLOSURE OF THE INVENTION

Figure 1A:
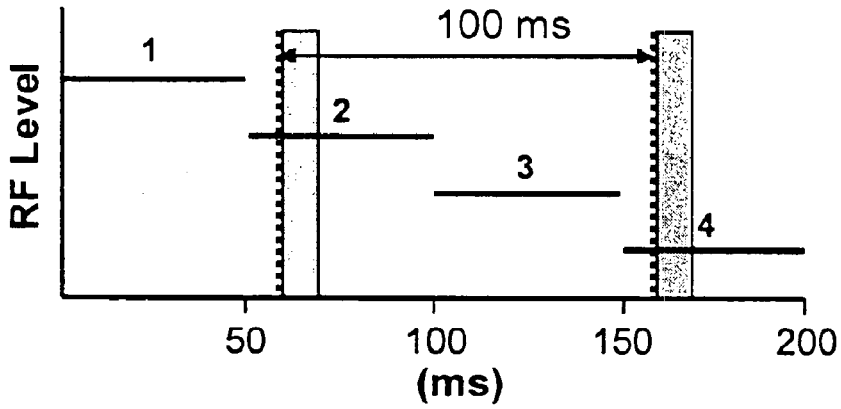
FIGS. 1A and 1B shows plots of RF level vs. time for a QIT-MS scan function. (A) Diagram depicting a typical AP-LD-QIT-MS experiment with a 200 ms ion injection period having four levels of injection RF, each persisting ~50 ms. Dashed lines represent laser pulses separated by 100 ms (10 Hz) with the shaded area displaying the resulting 10 ms ion pulse. (B) Diagram depicting an optimized AP-LD-QIT-MS experiment. Ion trapping period reduced to 40 ms with laser pulses separated by 10 ms (100 Hz) triggered to fire with the onset of each injection RF level.

The subject invention provides improved methods for injecting ions into a quadrupole ion trap mass spectrometer (QIT-MS). The methods of the subject invention are applicable to procedures involving atmospheric pressure laser desorption (AP-LD) of a sample to be investigated. Specifically, the subject invention involves controlling the pulse frequency of the laser such that the laser pulses are synchronized with changes in radiofrequency (RF) amplitude levels of the QIT-MS. Advantageously, by utilizing the methods of the subject invention it is possible to improve the ion injection efficiency, and thus reproducibility of the results while improving duty cycle and reducing sample consumption.

Typically, QIT-MS systems are designed to use several levels of RF amplitude during a fixed ion injection period to optimally inject and store ions across a desired mass range, as each RF amplitude level used is optimal for injection and storage of ions within a certain mass-to-charge ratio (m/z) range. Prior AP-LD techniques used for injecting and storing ions into a QIT-MS have used laser pulses that are not at all synchronized with the RF amplitude levels of the QIT-MS. In contrast, in a preferred embodiment the subject method utilizes laser pulses that are synchronized to changes in the RF amplitude levels of the QIT-MS.

The subject invention finds applicability with both the traditional 3-dimensional quadrupole ion trap mass spectrometer (3D-QIT-MS) and the newer linear quadrupole ion trap mass spectrometer (L-QIT-MS). In a specific embodiment, the subject invention involves synchronizing laser pulses with the ion injection period of a L-QIT-MS. In a further specific embodiment, the laser pulses need not be synchronized with the ion injection period of the L-QIT-MS, but the laser pulses are caused to stop being incident on the sample during a portion, or all, of the time period outside the ion injection period of the L-QIT-MS. In another further specific embodiment, the laser pulses need not be synchronized with the ion injection period or the RF amplitude transitions of the 3 dimensional QIT-MS, but the laser pulses are caused to stop being incident on the sample during a portion, or all, of the time period outside the ion injection period of the 3 dimensional QIT-MS. By causing the laser pulses to stop being incident on the sample during a portion of, or all, of the time period outside the ion injection period of the 3D-QIT-MS or L-QIT-MS, sample waste can be reduced, or prevented. Causing the laser pulses to stop being incident on the sample can be accomplished by turning the laser off, blocking the laser beam from the sample, redirecting the laser beam away from the sample, or by other means known in the art. Preferably, the laser pulses are caused to stop being incident on the sample during the entire time period outside of the ion injection period of the 3D-QIT-MS or L-QIT-MS. In a specific embodiments the laser pulses can be stopped from being incident on the sample during at least a portion of the time period outside of the ion injection period, and preferably the entire time period outside of the ion injection period, of the L-QIT-MS, and the laser pulses incidient on the sample are synchronized with the ion injection period of the L-QIT-MS and/or synchronized with the RF amplitude changes of the L-QIT-MS. In another specific embodiment, the laser pulses can be stopped from being incident on the sample during at least a portion of the time period outside of the ion injection period, and preferably the entire time period outside of the ion injection period, of the 3D-QIT-MS, and the laser pulses incident on the sample are synchronized with the ion injection period and/or synchronized with the RF amplitude changes of the 3D-QIT-MS.

In a particularly preferred embodiment of the subject invention, the same number of laser pulses is incident on the sample during each RF amplitude level of the QIT-MS. In a specific embodiment, one laser pulse is incident on the sample during each RF amplitude level of the QIT-MS. In another specific embodiment, at least two laser pulses are incident on the sample during each RF amplitude level of the QIT-MS. In a further specific embodiment, at least two laser pulses and the same number of laser pulses are incident on the sample during each RF amplitude level of the QIT-MS. In this way, sample ions are generated for injection and storage in the QIT-MS for an approximately equal duration during each RF amplitude level of the QIT-MS so that ions of all mass-to-charge ratios can be successfully injected and stored.

In one embodiment, the subject invention further comprises timing the RF amplitude level changes in the QIT-MS to coincide with the duration of ion generation following each laser pulse.

The subject invention arises from the discovery that the ion pulse produced during LD-APCI and AP-MALDI is relatively short, ~10 ms. With such short ion pulses, asynchronous modes of coupling AP-LD to QIT-MS will typically result in duty cycles on the order of only ~4%. Furthermore, random laser pulses within a fixed ion injection period produce highly erratic mass spectra when scanning across a wide mass range due to the injection of ions into varying levels of RF amplitude. To solve these problems, the instruments and methods of the subject invention utilize rapid laser pulses that are synchronized to changes in the injection RF levels. This reduces sample consumption, improves duty cycle, and provides enhanced scan-to-scan reproducibility.

In a preferred embodiment of the subject invention, the AP-LD-QIT-MS interface has lasers that operate with high repetition rates (~100 Hz), and the ion pulses they generate are triggered to correspond with changes in injection RF levels so that the entire mass range can be consistently injected into the ion trap scan after scan.

By controlling the pulse frequency of the laser (e.g., from 10 Hz to 100 Hz), synchronously triggering the laser pulses with the changes in RF amplitude levels of the QIT-MS, and timing the laser pulses to the injection portion of the QIT-MS scan, sample consumption is reduced, the duty cycle is improved, and scan-to-scan reproducibility is improved, and the resultant analysis can be performed with higher precision across the entire mass range. The reduction in sample consumption is accomplished by turning off the laser pulses during the portion of the QIT-MS scan which is not related, to the injection of the ions. These portions of the QIT-MS scan include, for example, the mass analysis portion, pre-injection, post-injection, multiplier rise time, and post-scan time. The improvement in duty cycle results from the reduction of the QIT-MS injection period (e.g., from 200 ms to 40 ms) This is enabled by eliminating the period between when the generation of ions from one pulse ends to the time of the next pulse. The improvement in scan-to-scan reproducibility is due to having injection and storage of ions into the QIT-MS uniformly in each RF amplitude subperiod.

In a specific embodiment, the pulse frequency of the laser is between about 1 Hz and about 10 Hz. In another embodiment of the subject invention the pulse frequency of the laser is between about 10 Hz and about 100 Hz. In yet another embodiment of the subject invention the pulse frequency of the laser is between about 100 Hz and about 1000 Hz.

The subject invention can be applied to a variety of techniques incorporating incidenting laser pulses on the sample to achieve atmospheric pressure laser desorption (AP-LD). Such techniques include, but are not limited to atmospheric pressure matrix assisted laser desorption ionization (AP-MALDI), atmospheric pressure: laser desorption/ionization from porous silicon (AP-DIOS), and laser desorption-atmospheric pressure chemical ionization (LD-APCI).

Further, with knowledge of the temporal ion pulse width produced from a desorption event, the laser repetition rate can be optimized. In a specific embodiment, the laser repetition rate can be approximately $1/T_{IP}$, where $T_{IP}$ is the ion pulse width. For example, in a specific embodiment incorporating LD-APCI, an ion pulse width of ~10 ms was achieved. In this case, operation of the laser at a repetition rate of 100 Hz (110 ms=100 Hz) can produce an approximately continuous supply of ions for MS sampling. Accordingly, based on the ion pulse width, the laser pulse repetition rate can be selected, or adjusted, to produce an approximately continuous ion supply. In a specific embodiment of the subject invention, Automatic Gain Control (AGC) is utilized in conjunction with the AP-LD measurement. QIT-MS systems typically operate optimally when a set value of ions are injected into the device scan after scan. AGC is a method implemented to vary the ion injection period (time ions are allowed to enter the QIT) to provide a constant number of ions. The constant number of ions can be a target value preset by the user. AGC is typically utilized with an ion source capable of providing a continuous supply of ions, e.g., electrospray (ESI). Prior AP-laser desorption approaches have produced pulsed supplies of ions and, thus, AGC has not been utilized. By optimizing the laser repetition rate to produce an approximately continuous supply of ions, the subject method can allow operation of AGC and thus further extend the utility of the AP-LD methods. In a specific embodiment operation of the laser repetition rate is approximately 100 Hz and, therefore, sample consumption per time can be a factor of 10 higher as compared to an embodiment having a laser repetition rate of 10 Hz. To reduce the rate of sample consumption, the subject invention can synchronize the laser pulses to the mass spectrometric scanning, such that, for example, the laser only fires during times of ion injection. In this way, sample waste is reduced or eliminated.

In a specific embodiment of the subject invention, the QIT-MS control software causes the mass spectrometer to monitor the temporal pulse width of the desorbed ions and automatically adjusts the laser pulse frequency to maintain production of a continuous ion supply. In specific embodiments, for example with respect to AP-MALDI, changes in the crystal structure of the matrix could change the temporal ion pulse profile, such that automatic adjustment of laser pulse frequency can allow the subject invention to maintain an approximately continuous ion supply.

All patents, patent applications, provisional applications, and publications referred to or cited herein are incorporated by reference in their entirety, including all figures and tables, to the extent they are not inconsistent with the explicit teachings of this specification.

Following are examples which illustrate procedures for practicing the invention. It will be apparent to those skilled in the art that the examples involve use of materials and reagents that are commercially available from known sources, e.g., chemical: supply houses, so no details are given respecting them. These examples should not be construed as limiting.

EXAMPLE 1

Enhanced Performance with Rapid, Synchronized Laser Pulses

Figure 1B:
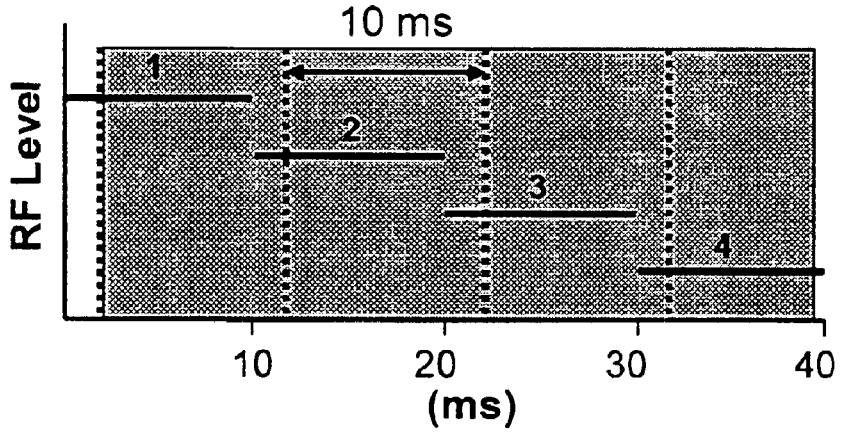

FIGS. 1A and 1B illustrate certain advantages of the subject invention over the prior art. FIG. 1A shows how, in accordance with the prior art, two consecutive laser pulses (vertical dotted lines) separated by 100 milliseconds (ms), representing a 10 Hz operation cycle of the laser, align in a random fashion with a 200 ms ion injection period of the QIT-MS. The 200 ms injection period of the QIT-MS is broken down into four 50 ms subperiods, each with a different RF amplitude level favoring the injection and storage of a different ion m/z range. As seen in FIG. 1A, the laser pulses (vertical dotted lines) only occur during the second and fourth subperiods of the 200 ms injection period. The shaded areas following the laser pulses represent the amount of time during which ions are being generated following the laser pulse. As can be seen from FIG. 1A, no ions are generated during the first or third subperiod. Therefore, the ions m/z's that are favored during the first and third subperiods are not appropriately represented in the QIT-MS measurement. In addition, there is much time between the end of the first shaded area and the next laser pulse, during which no ions are being generated for injection and storage.

FIG. 1B shows how, in accordance with the subject invention, four consecutive laser pulses (vertical dotted lines) separated by 10 ms, representing a 100 Hz operation cycle of the laser, align with a 40 ms injection period of the QIT-MS. The 40 ms injection period of the QIT-MS is broken down into four 10 ms subperiods, each with a different RF amplitude level favoring the injection and storage of a different ion m/z range. As seen in FIG. 1B, the laser pulses (vertical dotted lines) occur one during each of the four subperiods of the 40 ms injection period of the QIT-MS. Again, the: shaded areas following each laser pulse represent the amount of time during which ions are being generated following the laser pulse. As shown, ions are being generated by the laser pulses during essentially the entire injection period of the QIT-MS. In addition, the pulsing of the laser can be turned off during the portion of the QIT-MS scan that is not related to the injection of the ions. These portions of the QIT-MS scan include, for example, the mass analysis portion, pre-injection, post-injection, multiplier rise time, and post-scan time.

EXAMPLE 2

Temporal Pulse Width

In accordance with the subject invention, the temporal width of ion pulses generated following a laser desorption event at AP is of notable significance for the optimal coupling of all AP-LD methods to QIT-MS. As illustrated below, in a preferred embodiment, the subject invention improves the temporal ion pulse profiles generated during AP-LD.

Two different solutions of spiperone, an anti-psychotic pharmaceutical, in a matrix of glycerol were prepared. The first, at 8 ppm, was used for LD-APCI analysis; the second, at a level of 100 ppm with 0.1% trifluoroacetic acid, was employed under AP-MALDI conditions. A $CO_2$ laser emitting photons at 10.6 $\mu$m, having a fluence of ~5500 J/m$^2$ for AP-MALDI and ~2500 J/m$^2$ for LD-APCI, was used for desorption and was triggered to fire at the beginning of the ion trapping period. During LD-APCI, desorbed neutral analyte molecules were then ionized in the gas-phase by reagent ions produced by a corona discharge (Coon J J, McHale K J, Harrison W W, 2002, *Rapid Communications in Mass Spectrometry* 16:681–685; Coon J J, Harison W W, 2002, *Analitical Chemistry* 74). For AP-MALDI, the corona discharge was not used, but all other conditions, except laser fluence, were held constant.

Figure 2:
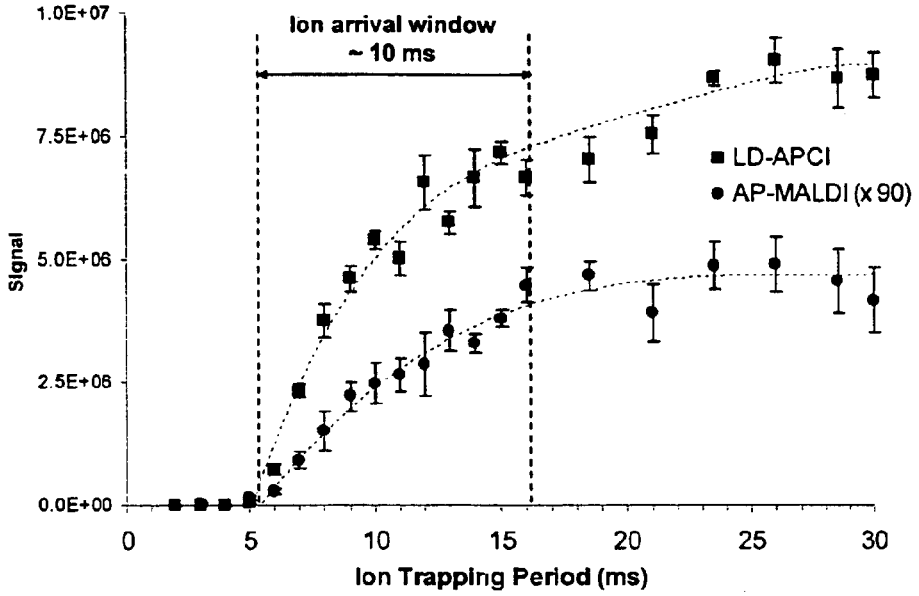
FIG. 2 shows ion signals for LD-APCI and AP-MALDI (signal ×90) as a function of ion trapping period.

Under continuous scanning, the ion-trapping period was varied from 0 to 100 ms in small increments. Afterwards, 10 scans, each composed of 10 single-shot mass spectra, were averaged from each ion trapping period segment and the absolute signal intensity of the spiperone protonated molecule was plotted vs. the magnitude of the ion trapping period (FIG. 2). Note the AP-MALDI generated signal was multiplied by a factor of 90. In both cases, ions were first detected at a trapping period of ~6 ms with the signal increasing as the trapping period was lengthened. Extending the trapping period past 30 ms did not show significant increases in ion signal.

Figure 3:
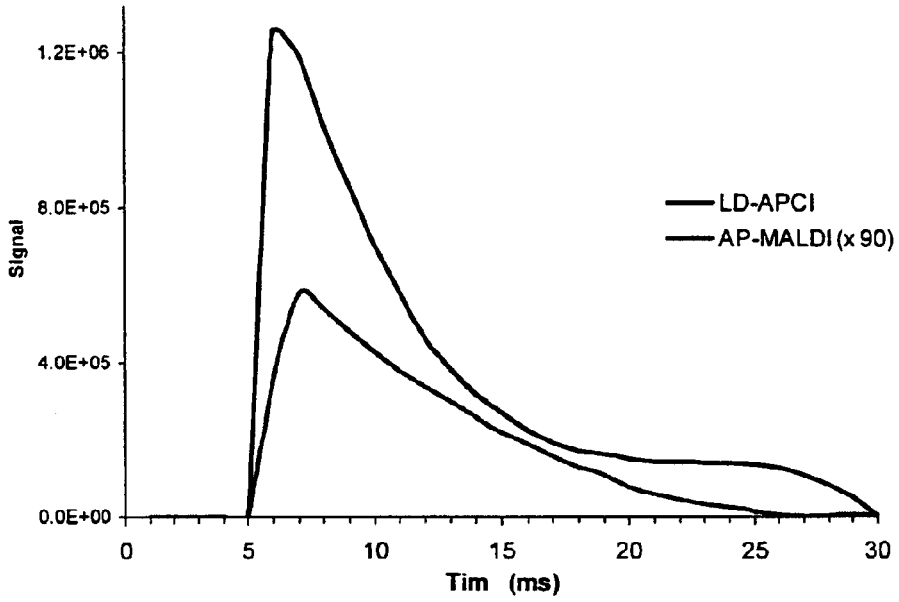
FIG. 3 shows a plot of temporal ion flux for LD-APCI and AP-MALDI (signal ×90). The ions initially arrive at the ion trap ~5 ms after the laser pulse (t=0). In both methods, the bulk of the ions arrive within a 10 ms window.

Polynomial curves were fit to each data series and are also shown in FIG. 2. Using the equation from each curve, ion intensities were calculated for ion trapping periods from 0–30 ms in 1 ms increments. The magnitude of change between each trapping time was calculated and plotted in FIG. 3. This plot represents the temporal ion flux during LD-APCI and AP-MALDI and demonstrates that the majority of the ion flux occurs during a 10 ms period for both methods.

In each case the earliest ion-trapping period that ions were observed was between 5 and 6 ms, which is also the period that carries the greatest ion flux. The 5 ms delay can be attributed to transport time, i.e., for any given set of AP-LD parameters there exists a fixed time required for ion transport from AP into the ion trap. Following that period, the largest flux of ions arrives at the ion trap during the following millisecond, after which ions continue to be formed over the course of the next 20–25 ms, but the signal continuously decays.

For AP-MALDI, a process that accomplishes desorption and ionization in a single-step rather than two as in LD-APCI, it is surprising that the temporal ion flux occurs on about the same time-scale. But since the chemical ionization is occurring at AP, where protonation reactions will occur on a rapid time-scale, ion transport is evidently the lengthiest step. In either case, the bulk of the ion signal arrives over a relatively short 10 ms period. Therefore, ion pulses on the order of 10 ms, spaced 100 ms apart (10 Hz laser repetition rate) during asynchronous AP-LD experiments, can hardly be considered a continuous source of ions as previously suggested (Laiko U V, Taranenko N I, Berkout V D, Musselman, Doroshenko V M, 2002, *Rapid Communications in Mass Spectrometry* 16:1737–1742). Generation of a continuous ion beam would require sampling at repetition rates of 100 Hz (I pulse every 10 ms). However, sampling this rapidly is simply not compatible without synchronization because of rapid sample consumption.

With this data in mind, consider the following typical AP-LD scenario: a 200 ms ion trapping period for which AP-LD is to be performed asynchronously with a laser operating at 10 Hz on a QIT-MS. Let us assume that all steps comprising the scan function, aside from ion injection and mass analysis, (e.g., pre-injection, post-injection, multiplier rise time, post-scan time, etc.) consume 35 ms. We shall also assume that we wish to analyze across a mass range of 500–2000 m/z, a typical mass range for applications such as tryptic peptide analysis. With the normal scan-rate of 0.18 ms/amu, scanning would consume ~270 ms. The entire scan would persist 505 ms, with ion injection accounting for only 200 ms; of those; thus, the correlating duty cycle would be approximately 40% at best, putting only 1 or 2 of the 5 laser pulses to analytical use. Moreover, as described above, the majority of the ions are generated for only 10 ms following the laser pulse and, assuming 2 laser pulses occurred during ion injection, the resultant duty cycle would be ~4%. Further, to perform MS/MS, one of the most distinct advantages of the AP-LD-QIT-MS experiment, the duty cycle will drop even lower since additional time will be added to the scan function for ion isolation and fragmentation.

Besides the significant waste of sample in asynchronous AP-LD, ion injection is also a concern. Contemporary ion trap instruments with AP inlets typically utilize multiple levels of RF during ion injection so that all masses throughout the scan range will be successfully injected and stored. For the 200 ms ion injection period discussed above, FIG. 1A displays the four ion injection RF levels, with each lasting for ~50 ms. Also shown as dashed lines are two laser pulses separated by 100 ms (10 Hz operation) with the ion generation period shaded. Note that the pulses are always separated by 100 ms, but without synchronization they randomly shift from one scan to the next within the 200 ms window. An unfortunate artifact of this random shifting is that the ion pulses are randomly injected into different RF environments from one scan to the next; hence, a large number of averaged scans are needed to generate suitable spectra.

Figure 4:
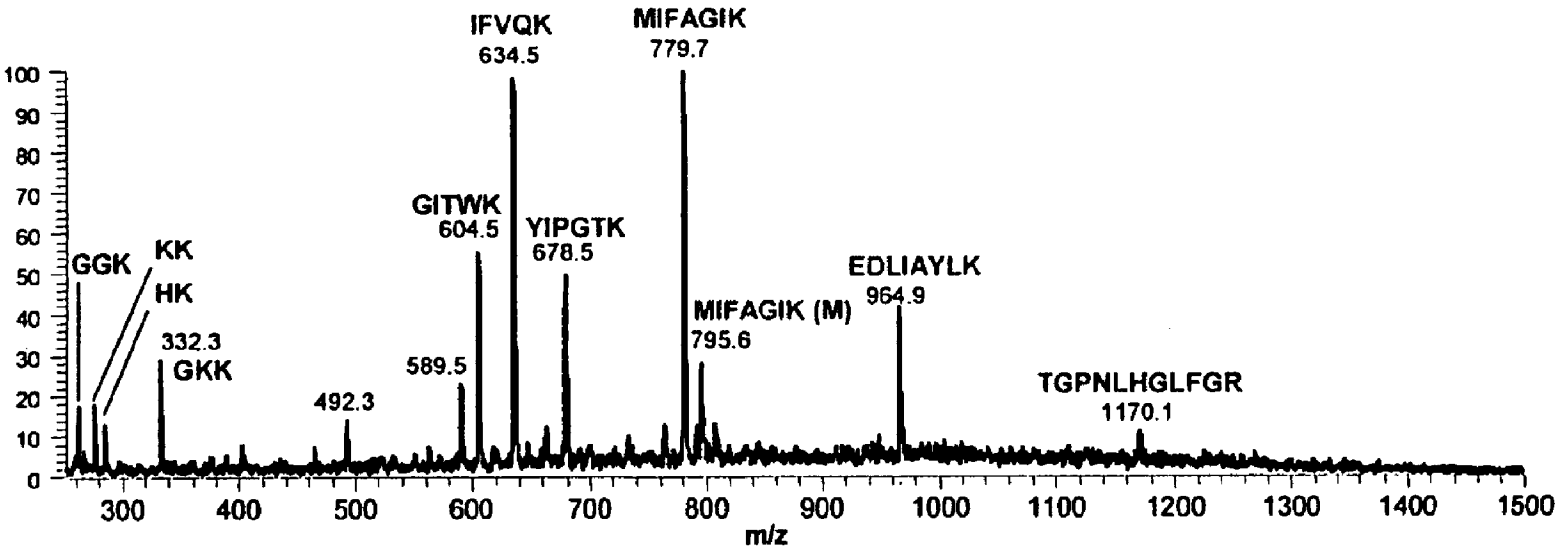
FIG. 4 shows LD-APCI-MS mass spectrum of a polyacrylamide gel containing an enzymatically (trypsin) digested protein (cytochrome c) with the detected tryptic peptides labeled. The mass spectrum was obtained using a fixed injection RF that was optimized for m/z's 779 and 634. Note peptides of lower and higher mass detected at lower abundances as a result of injection at non-optimal RF level.

This problem is not unique to the asynchronous mode of operation, but rather is universal to all AP-LD procedures. For example, FIG. 4 presents the LD-APCI-MS analysis of tryptic peptides of the protein cytochrome C directly from a polyacrylamide gel. In this work one laser pulse, triggered to fire at the onset of ion injection, was used to initiate the generation of an ion pulse that was collected at a single level of injection RF. The tryptic peptides should theoretically be produced at equal amounts, but the injection RF level is optimal for m/z's ~700, causing them to appear with the highest intensities, while those of lower or higher masses detected at lower abundances. Using multiple injection levels for a single laser pulse is also problematic because the majority of the ion signal arrives unevenly through the course of a 5–10 ms span. Furthermore, single laser pulses do not take advantage of the QIT's unique ability to store multiple laser pulses per mass analysis.

It should be understood that the examples and embodiments described herein are for illustrative purposes only and that various modifications or changes in light thereof will be suggested to persons skilled in the art and are to be included within the spirit and purview of this application.

I claim:

1. A method for injecting ions into a quadrupole ion trap mass spectrometer (QIT-MS), comprising:

cycling a QIT-MS through a plurality of radiofrequency (RF) amplitude levels, each RF amplitude level corresponding to the storing of ions in one of a corresponding plurality of ranges of ion mass-to-charge ratios;

incidenting a plurality of laser pulses on a sample during cycling the QIT-MS through a plurality of RF amplitude levels, wherein sample ions are generated each time one of the plurality of laser pulses in incident on the sample; and injecting the sample ions generated each time one of the plurality of laser pulses is incident on the sample into the QIT-MS such that a corresponding plurality of ion pulses is produced;

wherein incidenting the plurality of laser pulses on the sample is synchronized with cycling of the QIT-MS through the plurality of RF amplitude levels such that the same number of ion pulses are produced during each of the plurality of RF amplitude levels.

2. The method according to claim 1, wherein the QIT-MS is a 3-dimensional QIT-MS (3D-QIT-MS).

3. The method according to claim 1, wherein the QIT-MS is a linear QIT-MS (L-QIT-MS).

4. The method according to claim 1, wherein one ion pulse is produced during each of the plurality of RF amplitude levels.

5. The method according to claim 1, wherein at least two ion pulses are produced during each of the plurality of RF amplitude levels.

6. The method according to claim 1, wherein each ion pulse of the plurality of ion pulses is of an approximately equal duration.

7. The method according to claim 6, wherein each of the RF amplitude levels is maintained for a period of time corresponding to the duration of one of the ion pulses.

8. The method according to claim 5, wherein each of the RF amplitude levels is maintained for a period of time corresponding to the duration of the at least two ion pulses.

9. The method according to claim 1, wherein the duration of the ion pulses produced during each of the RF amplitude levels is approximately equal.

10. The method according to claim 1, wherein incidenting a plurality of laser pulses on the sample results in atmospheric pressure laser desorption (AP-LD) each time a laser pulse is incident on the sample.

11. The method according to claim 1, wherein incidenting a plurality of laser pulses on the sample results in atmospheric pressure matrix assisted laser desorption ionization (AP-MALDI) each time a laser pulse is incident on the sample.

12. The method according to claim 1, wherein incidenting a plurality of laser pulses on the sample results in atmospheric pressure laser desorption/ionization from porous silicon (AP-DIOS) each time a laser pulse is incident on the sample.

13. The method according to claim 1, wherein incidenting a plurality of laser pulses on the sample results in laser desorption-atmospheric pressure chemical ionization (LD-APCI) each time a laser pulse is incident on the sample.

14. The method according to claim 1, wherein synchronizing incidenting the plurality of laser pulses on the sample with cycling of the QIT-MS through the plurality of RF amplitude levels is accomplished by controlling the pulse frequency of the laser such that the laser pulses are synchronized with changes in RF amplitude levels of the QIT-MS.

15. The method according to claim 1, wherein the plurality of laser pulses is generated by a laser operating at a repetition rate of between about 10 Hz and about 100 Hz.

16. The method according to claim 1, wherein the plurality of laser pulses is generated by a laser operating at a repetition rate of between about 1 HZ and about 10 Hz.

17. The method according to claim 1, wherein the plurality of laser pulses is generated by a laser operating at a repetition rate of between about 100 Hz and about 1000 Hz.

18. The method according to claim 1, wherein synchronizing incidenting the plurality of laser pulses on the sample with cycling of the QIT-MS through the plurality of RF amplitude levels is accomplished by modifying software code of the QIT-MS.

19. The method according to claim 1, wherein cycling of the QIT-MS through a plurality of RF amplitude levels comprises timing the RF amplitude level changes to coincide with the duration of an ion pulse.

20. The method according to claim 1, further comprising:

cycling the QIT-MS through a QIT-MS scan; and turning off the laser pulses during portions of the QIT-MS scan which are not related to the injection of the sample ions.

21. The method according to claim 1, further comprising:

cycling the QIT-MS through one or more of the following portions of a QIT-MS scan:

mass analysis portion, pre-injection portion, post-injection portion, multiplier rise time, and post-scan portion; and turning off the laser pulses during at least one of the one or more portions of a QIT-MS scan through which the QIT-MS is cycled.

22. The method according to claim 1, wherein injecting the sample ions generated each time one of the plurality of laser pulses is incident on the sample into the QIT-MS occurs during an injection period of a QIT-MS scan.

23. The method according to claim 13, wherein the duration of the injection period is between about 40 ms and about 200 ms.

24. The method according to claim 1, wherein one laser pulse is incident on the sample during each of the plurality of RF amplitude levels.

25. The method according to claim 1, wherein at least two laser pulses are incident on the sample during each of the plurality of RF amplitude levels.

26. The method according to claim 1, wherein the plurality of laser pulses is generated by a laser operating at a repetition rate which results in an approximately continuous supply of ions.

27. The method according to claim 26, wherein the repetition rate of the laser is approximately $1/T_{IP}$, where $T_{IP}$ is the width of one of the plurality of ion pulses.

28. The method according to claim 26, further comprising:

utilizing automatic gain control (AGC).

29. The method according to claim 26, wherein QIT-MS control software causes the temporal pulse width of the plurality of ion pulses to be monitored by the QIT-MS and the repetition rate of the laser to be adjusted such that an approximately continuous supply of ion is maintained.

30. An apparatus for injecting ions into a quadrupole ion trap mass spectrometer (QIT-MS), comprising:

a means for cycling a QIT-MS through a plurality of radiofrequency (RF) amplitude levels, each RF amplitude level corresponding to the storing of ions in one of a corresponding plurality of ranges of ion mass-to-charge ratios;

a means for incidenting a plurality of laser pulses on a sample during cycling the QIT-MS through a plurality of RF amplitude levels, wherein sample ions are generated each time one of the plurality of laser pulses is incident on the sample; and a means for injecting the sample ions generated each time one of the plurality of laser pulses is incident on the sample into the QIT-MS such that a corresponding plurality of ion pulses is produced, wherein the means for incidenting a plurality of laser pulses on the sample is synchronized with the means for cycling the QIT-MS through a plurality of RF amplitude levels such that the same number of ion pulses are produced during each of the plurality of RF amplitude levels.

31. The apparatus according to claim 30, wherein the QIT-MS is a 3-dimensional QIT-MS (3D-QIT-MS).

32. The apparatus according to claim 30, wherein the QIT-MS is a linear QIT-MS (L-QIT-MS).

33. The apparatus according to claim 30, wherein the means for incidenting a plurality of laser pulses on the sample is synchronized with the means for cycling the QIT-MS through a plurality of RF amplitude levels such that one ion pulse is produced during each of the plurality of RF amplitude levels.

34. The apparatus according to claim 30, wherein the means for incidenting a plurality of laser pulses on the sample is synchronized with the means for cycling the QIT-MS through a plurality of RF amplitude levels such that each ion pulse of the plurality of ion pulses is of an approximately equal duration.

35. The apparatus according to claim 34, wherein the means for cycling a QIT-MS through a plurality of RF amplitude levels maintains each of the RF amplitude levels for a period of time corresponding to the duration of one of the ion pulses.

36. The apparatus according to claim 30, wherein the means for incidenting a plurality of laser pulses on the sample is synchronized with the means for cycling the QIT-MS through a plurality of RF amplitude levels such that the duration of the ion pulses produced during each of the RF amplitude levels is approximately equal.

37. The apparatus according to claim 30, wherein the means for incidenting a plurality of laser pulses on the sample causes atmospheric pressure laser desorption (AP-LD) each time a laser pulse is incident on the sample.

38. The apparatus according to claim 30, wherein synchronizing the means for incidenting a plurality of laser pulses on the sample with the means for cycling of the QIT-MS through the plurality of RF amplitude levels is accomplished by controlling the pulse frequency of the laser such that the laser pulses are synchronized with changes in RF amplitude levels of the QIT-MS.

39. The apparatus according to claim 30, wherein the means for incidenting a plurality of laser pulses on a sample comprises a laser operating at a repetition rate of between about 10 Hz and about 100 Hz.

40. The apparatus according to claim 30, wherein the means for incidenting a plurality of laser pulses on a sample comprises a laser operating at a repetition rate of between about 1 Hz and about 10 Hz.

41. The apparatus according to claim 30, wherein the means for incidenting a plurality of laser pulses on a sample comprises a laser operating at a repetition rate of between about 100 Hz and about 1000 Hz.

42. The apparatus according to claim 30, wherein the means for cycling a QIT-MS through a plurality of RF amplitude levels comprises software code for the synchronizing the means for incidenting a plurality of laser pulses on the sample with the means for cycling a QIT-MS through a plurality of RF amplitude levels.

43. The apparatus according to claim 30, wherein the means for cycling a QIT-MS through a plurality of RF amplitude levels comprises a means for timing the RF amplitude level changes to coincide with the duration of an ion pulse.

44. The apparatus according to claim 30, further comprising:

a means for cycling the QIT-MS through a QIT-MS scan, wherein the means for incidenting a plurality of laser pulses on sample comprises a means for turning off the laser pulses during portions of the QIT-MS scan which are not related to the injection of the ions.

45. The apparatus according to claim 30:

wherein the means for cycling a QIT-MS through a plurality of RF amplitude levels comprises a means for cycling the QIT-MS through one or more of the following portions of a QIT-MS scan:

mass analysis portion, pre-injection portion, post-injection portion, multiplier rise time, and post-scan portion, wherein the means for incidenting a plurality of laser pulses on a sample comprises a means for turning off the laser pulses during at least one of the one or more portions of a QIT-MS scan.

46. The apparatus according to claim 30:

wherein the means for incidenting a plurality of laser pulses on the sample is synchronized with the means for cycling the QIT-MS through a plurality of RF amplitude levels such that one laser pulse is incident on the sample during each of the plurality of RF amplitude levels.

47. The apparatus according to claim 30, wherein the means for incidenting a plurality of laser pulses on a sample incidents the plurality of laser pulses at a repetition rate which results in an approximately continuous supply of ions.

48. The apparatus according to claim 47, wherein the repetition rate is approximately $1/T_{IP}$, where $T_{IP}$ is the width of one of the plurality of ion pulses.

49. The apparatus according to claim 47, further comprising:

a means for utilizing automatic gain control with respect to QTI-MS.

50. A method for injecting ions into a quadrupole ion trap mass spectrometer (QIT-MS), comprising:

cycling a QIT-MS through a QIT-MS scan having an ion injection period, wherein ions can be injected into the QIT-MS during the ion injection period, incidenting a plurality of laser pulses on a sample during the QIT-MS scan, wherein sample ions are generated each time one of the plurality of laser pulses in incident on the sample; and injecting the sample ions generated each time one of the plurality of laser pulses is incident on the sample into the QIT-MS such that a corresponding plurality of ion pulses is produced;

wherein incidenting the plurality of laser pulses on the sample is stopped during at least a portion of the time period outside of the ion injection period of the QIT-MS scan.

51. The method according to claim 50, wherein incidenting the plurality of laser pulses on the sample is stopped during substantially all of the portion of the time period outside of the ion injection period of the QIT-MS scan.

52. The method according to claim 50, wherein cycling the QIT-MS through a QIT-MS scan having ion injection period comprises cycling the QIT-MS through a plurality of radiofrequency (RF) amplitude levels during the ion injection period, each RF amplitude level corresponding to the storing of ions in one of a corresponding plurality of ranges of ion mass-to-charge ratios.

53. The method according to claim 50, wherein the QIT-MS is a 3-dimensional QIT-MS (3D-QIT-MS).

54. The method according to claim 50, wherein the QIT-MS is a linear QIT-MS (L-QIT-MS).

* * * * *

UNITED STATES PATENT AND TRADEMARK OFFICE

CERTIFICATE OF CORRECTION

PATENT NO. : 6,878,933 B1
APPLICATION NO. : 10/732972
DATED : April 12, 2005
INVENTOR(S) : Joshua J. Coon It is certified that error appears in the above-identified patent and that said Letters Patent is hereby corrected as shown below:

Column 5,
Line 9, "3 dimensional" should read --3-dimensional --.

Column 6,
Line 44, "atmospheric pressure: laser" should read -- atmospheric pressure laser --.

Column 6,
Line 55, "(110 ms = 100 Hz)" should read --(1/10ms = 100 Hz)--.

Column 7,
Line 37, "chemical: supply houses" should read --chemical supply houses--.

Column 9,
Line 21, "(Laiko U V, Taranenko" should read -- (Laiko VV, Taranenko--.

Column 9,
Line 25, "(I pulse every 10 ms)." should read -- (1 pulse every 10 ms).--.

Column 9,
Line 35, "consume 35 ms." should read -- consume ~ 35 ms.--.

Signed and Sealed this

Twelfth Day of June, 2007

JON W. DUDAS
*Director of the United States Patent and Trademark Office*